US007721384B2

(12) United States Patent
Crevling, Jr. et al.

(10) Patent No.: US 7,721,384 B2
(45) Date of Patent: May 25, 2010

(54) PNEUMATIC CLEANER

(75) Inventors: Robert L. Crevling, Jr., Williamsport, PA (US); Craig A. Seasholtz, Avis, PA (US); Matthew S. Kepner, Watsontown, PA (US)

(73) Assignee: Shop-Vac Corporation, Williamsport, PA (US)

( * ) Notice: Subject to any disclaimer, the term of this patent is extended or adjusted under 35 U.S.C. 154(b) by 1171 days.

(21) Appl. No.: 11/213,387

(22) Filed: Aug. 25, 2005

(65) Prior Publication Data

US 2007/0044270 A1 Mar. 1, 2007

(51) Int. Cl.
*A47L 5/36* (2006.01)

(52) U.S. Cl. ..... 15/327.5; 15/352; 55/356; 55/429

(58) Field of Classification Search ..... 15/327.5, 15/328, 352, 353, 413, 323, 314, 301, 327.1; 55/356, 429, 385.1
See application file for complete search history.

(56) References Cited

U.S. PATENT DOCUMENTS 3,910,781 A * 10/1975 Bryant, Jr. ..... 55/305
4,044,421 A 8/1977 Kristenson et al.
4,325,162 A 4/1982 Chambers et al.
4,570,286 A 2/1986 Ross
4,673,424 A 6/1987 Range
4,809,398 A 3/1989 Linduist et al.
4,934,019 A 6/1990 Shorthill et al.
4,955,646 A 9/1990 Jankevics
5,011,058 A 4/1991 Sapp et al.
5,052,073 A 10/1991 Iida
5,195,208 A 3/1993 Yamami et al.
5,267,371 A * 12/1993 Soler et al. ..... 15/327.5
5,388,301 A 2/1995 Bosyj et al.
5,404,614 A 4/1995 Stephens
5,406,673 A 4/1995 Bradd et al.
5,536,072 A 7/1996 Chang
5,588,177 A * 12/1996 Eriksen ..... 15/327.5
5,660,493 A 8/1997 Stephens
5,664,285 A 9/1997 Melito et al.
5,813,088 A 9/1998 Wagner et al.
6,055,700 A 5/2000 Holsten et al.

(Continued)

FOREIGN PATENT DOCUMENTS

EP 1 232 717 A2 8/2002

(Continued)

OTHER PUBLICATIONS

International Preliminary Report on Patentability for International Application No. PCT/US2006/033197, dated Feb. 26, 2008.

(Continued)

*Primary Examiner*—Gary K Graham
(74) *Attorney, Agent, or Firm*—Marshall, Gerstein & Borun LLP

(57) ABSTRACT

A pneumatic cleaner that can be worn as a backpack has a reduced unit overall depth. The impeller shaft is mounted at an acute angle. Tangential airflow chambers are disposed around the motor assembly and substantially surround the impeller. Two of the airflow chambers extend substantially the entire overall unit depth, and have lateral lengths that exceed the overall unit depth.

23 Claims, 17 Drawing Sheets

U.S. PATENT DOCUMENTS

| | | | | |
|---|---|---|---|---|
| 6,131,239 | A * | 10/2000 | White | 15/352 |
| RE37,081 | E | 3/2001 | Eriksen | |
| 6,305,048 | B1 | 10/2001 | Salisian | |
| 6,370,729 | B2 | 4/2002 | Miyamoto | |
| 6,375,696 | B2 | 4/2002 | Wegelin et al. | |
| 6,385,810 | B1 | 5/2002 | Lang | |
| 6,553,610 | B1 * | 4/2003 | Shideler | 15/327.5 |
| 6,568,026 | B2 | 5/2003 | Roy et al. | |
| 6,746,059 | B2 | 6/2004 | Thomas | |
| 2003/0005547 | A1 | 1/2003 | Bone | |
| 2003/0070250 | A1 | 4/2003 | Roy et al. | |
| 2004/0188230 | A1 | 9/2004 | Tate et al. | |

FOREIGN PATENT DOCUMENTS

| | | | |
|---|---|---|---|
| EP | 1 559 359 | A2 | 8/2005 |
| WO | WO 01/74025 | A1 | 10/2001 |
| WO | WO 03/101271 | A1 | 12/2003 |

OTHER PUBLICATIONS

Jan. 11, 2007—International search report results from corresponding PCT application PCT/US2006/033197.

Written Opinion for International Application No. PCT/US2006/033197, dated Apr. 19, 2007.

* cited by examiner

PNEUMATIC CLEANER

BACKGROUND OF THE INVENTION

The present invention relates generally to pneumatic cleaners (vacuums, blowers, etc.), and more particularly to vacuum cleaners that can be worn as a backpack.

Over the years, vacuum cleaners and blowers have been adapted for many different uses. Generally, powerful units are large, bulky, and inherently noisy. Interior ducting is commonly used to dampen the noise produced by a motor and internal airflow. This ducting further increases the bulk of a unit.

Portability is a common concern. To improve portability, some vacuums or blowers (including those seen in U.S. Pat. Nos. 6,647,586; 6,115,879; 5,040,263; and 4,223,419) have been designed with a strap that can be slung over a user's shoulder. Others (including those seen in U.S. Pat. Nos. 6,473,933; 6,151,749; 6,066,211; and 4,944,065) have been designed with waist belts. Still others (including those seen in U.S. Pat. Nos. 6,857,163; 6,568,026; 6,553,610; 6,431,024; 6,295,692; 6,073,301; 5,267,371; 4,748,712; 4,658,778; and RE37,081) have been designed to be worn as backpacks.

One problem with backpack vacuums is that the size and depth of a quiet, powerful unit can make the unit awkward to carry.

BRIEF SUMMARY OF THE INVENTION

The applicants have a developed an arrangement that is relatively manageable in size and configuration yet can still provide relatively quiet, powerful operation.

BRIEF DESCRIPTION OF THE DRAWINGS

The invention may be better understood by referring to the accompanying drawings, in which.

DETAILED DESCRIPTION OF A PREFERRED EMBODIMENT

Figure 1:
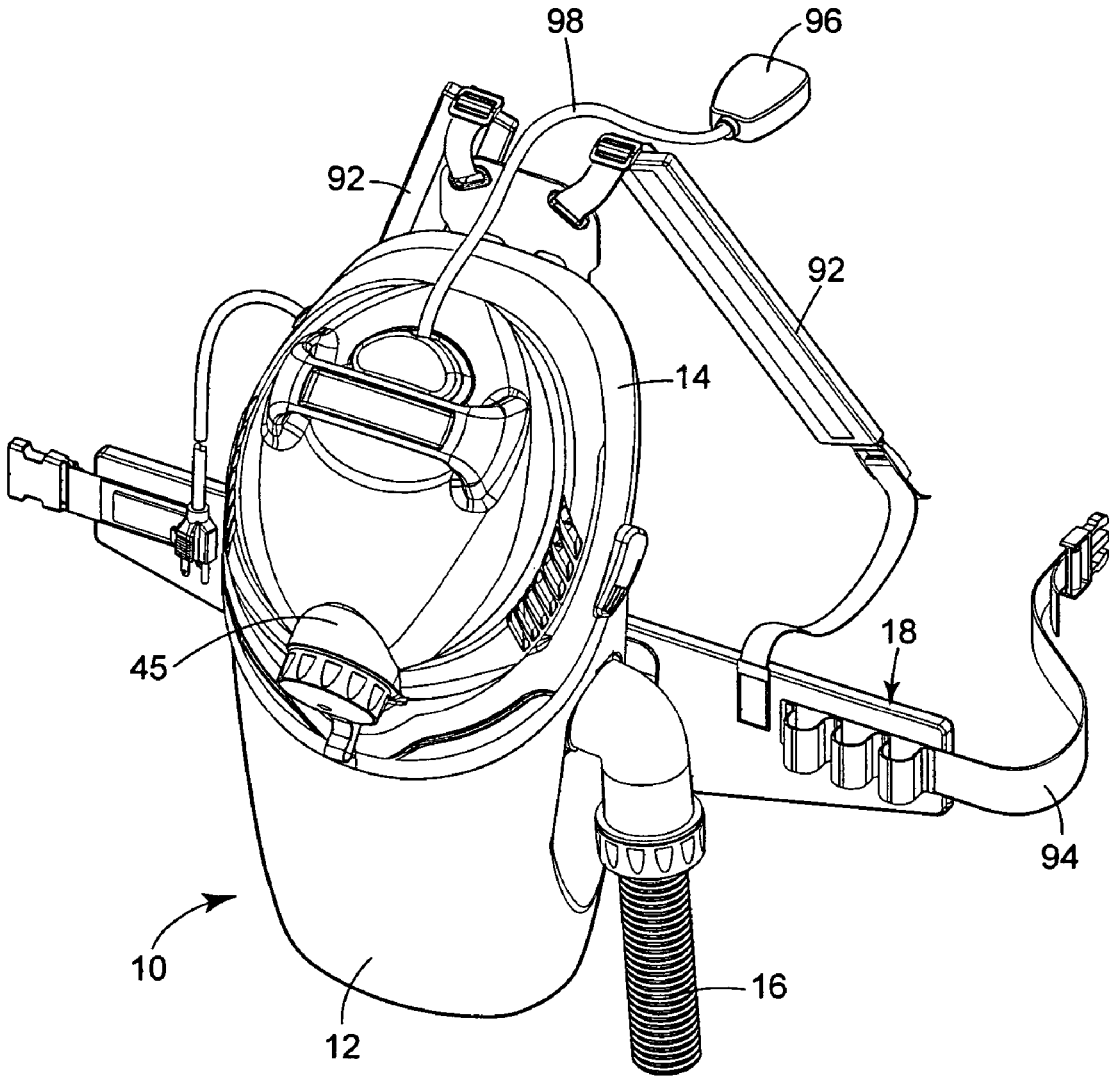
FIGS. 1 and 2 are isometric views of one form of a backpack vacuum that uses the invention.
Figure 2:
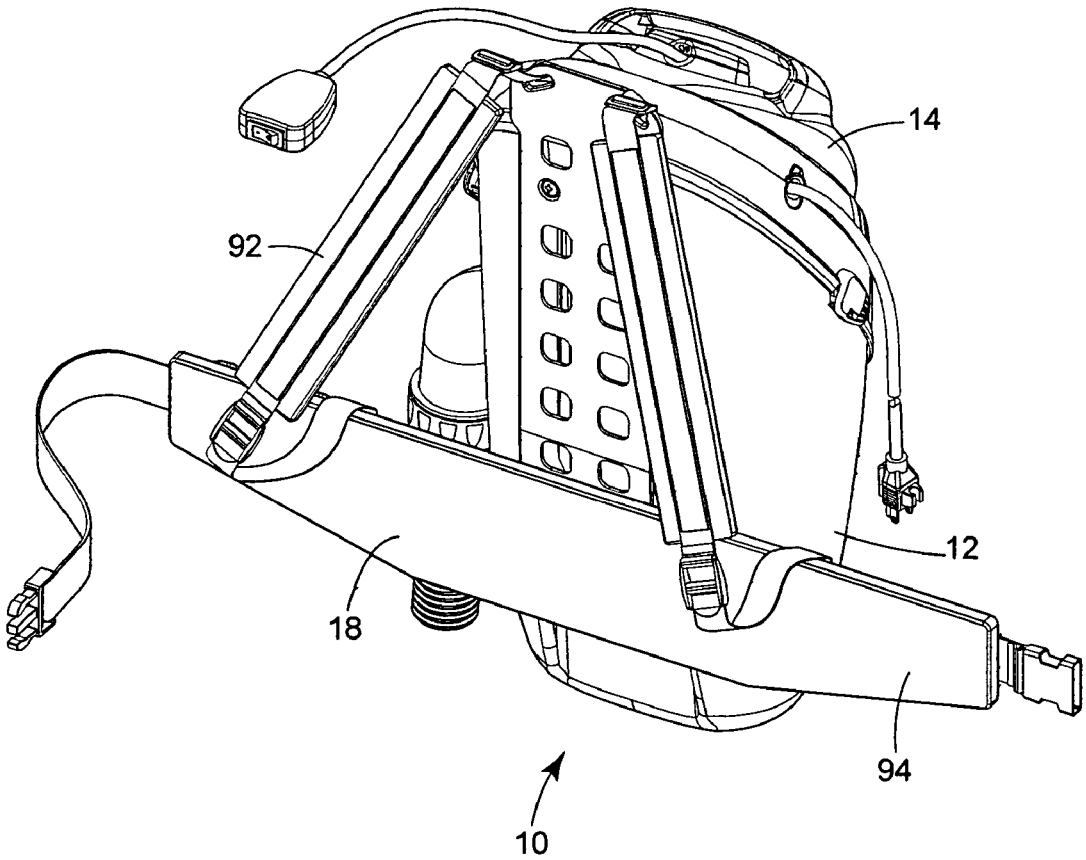
Figure 3:
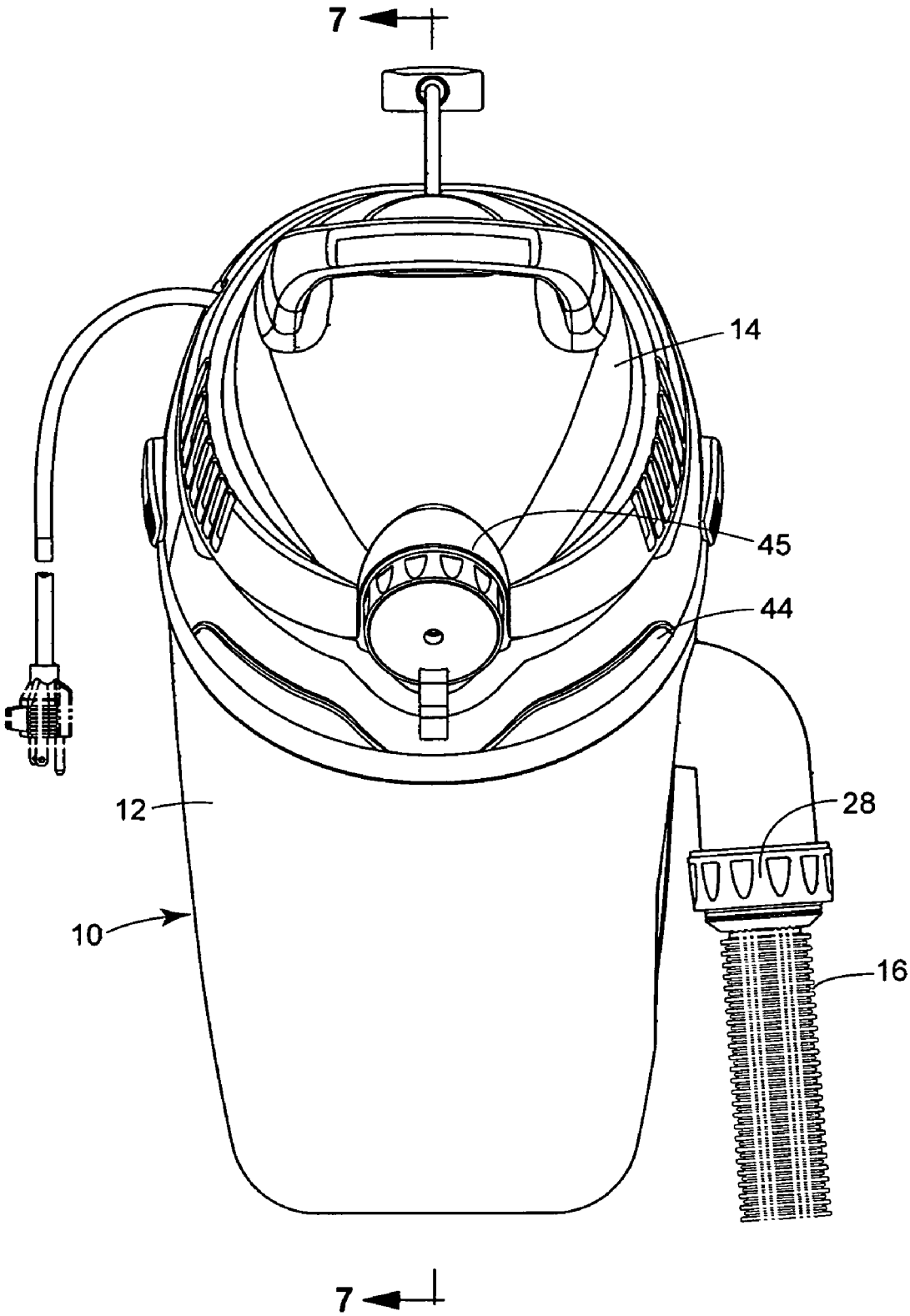
FIG. 3 is an elevational view from the back of the vacuum of FIG. 1, with the harness removed.

FIGS. 1-6 depict one form of pneumatic cleaner that can be built using the invention. The illustrated cleaner is a vacuum 10. The vacuum has a tank 12, a lid assembly 14, a hose 16, and a harness 18 that allows the vacuum to be carried as a backpack.

The Tank

The illustrated tank 12 is a dirt tank with tanks walls 22 (best seen in FIG. 7) that rise from a tank bottom 24 around a tank axis 26 that parallels the front of the tank (the part of the tank that, in use, forms an unhinged panel 27 toward the user's back). The illustrated tank axis 26 (FIG. 7) is vertical, but it could also be angled with respect to the vertical. The upper edge 30 of the tank lies on a plane 31 that is canted at an angle of approximately 35 degrees with respect to the tank axis 26. Preferably, the plane 31 is canted at an angle between 25° and 75° degrees with respect to the tank axis 26 and/or to the vertical. In cross section (as can be discerned from FIG. 6), the illustrated dirt tank 12 has a generally oval shape, is approximately 22 inches tall, 12 inches wide, and 8 inches deep, and has an internal tank volume of approximately 900 cubic inches. Other tank configurations could also be used. For example, the tank could take the form of a recovery tank for an extractor, a simple lower housing for a blower, etc. The tank can be made from a variety of materials, including rigid plastic.

Air is drawn into the illustrated tank 12 through the hose 16, which can be connected to the tank by a conventional tank inlet fitting 28.

The Lid Assembly

Figure 4:
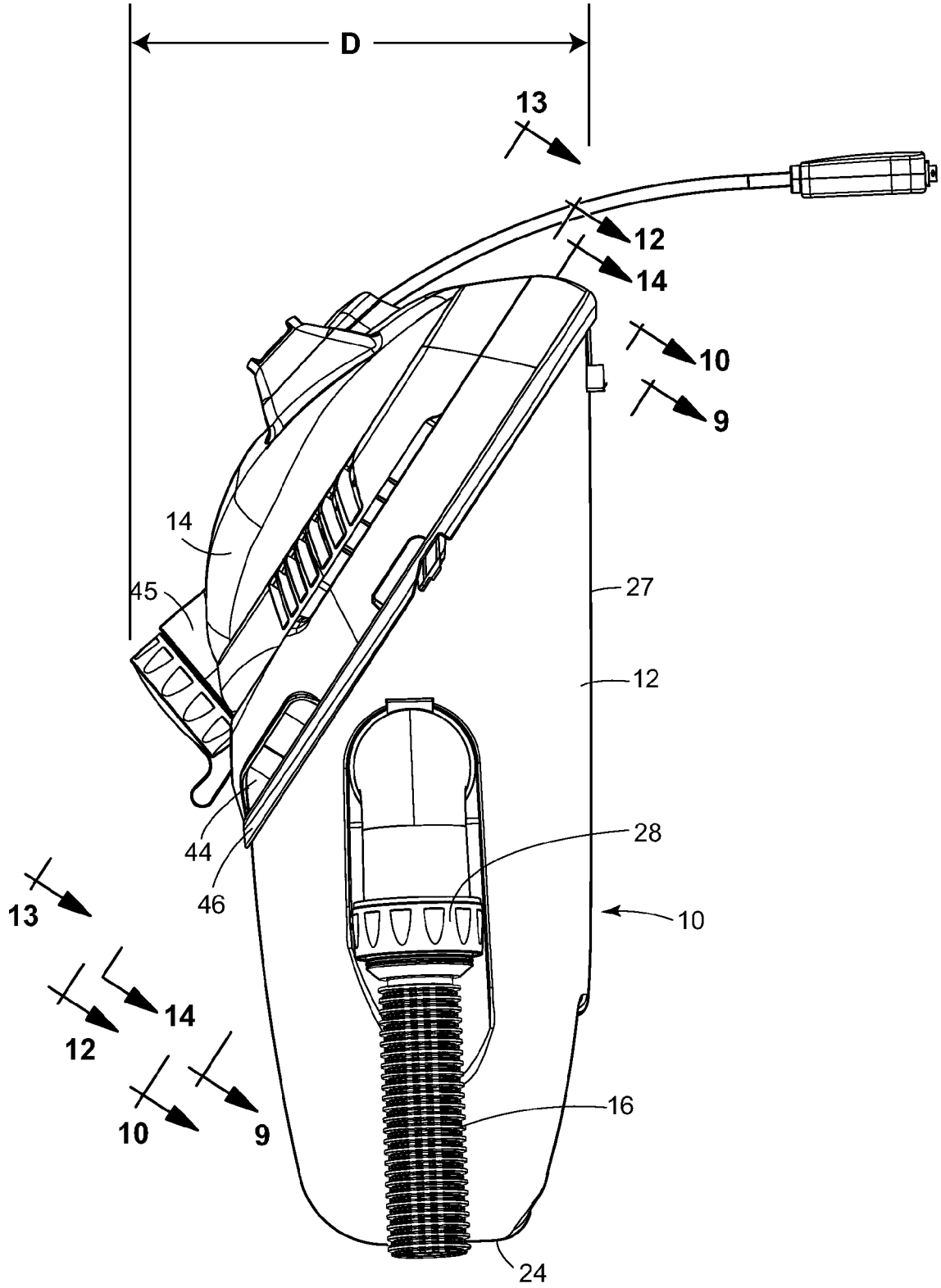
FIGS. 4 and 5 are opposite elevational side views of the vacuum, again with the harness removed.
Figure 5:
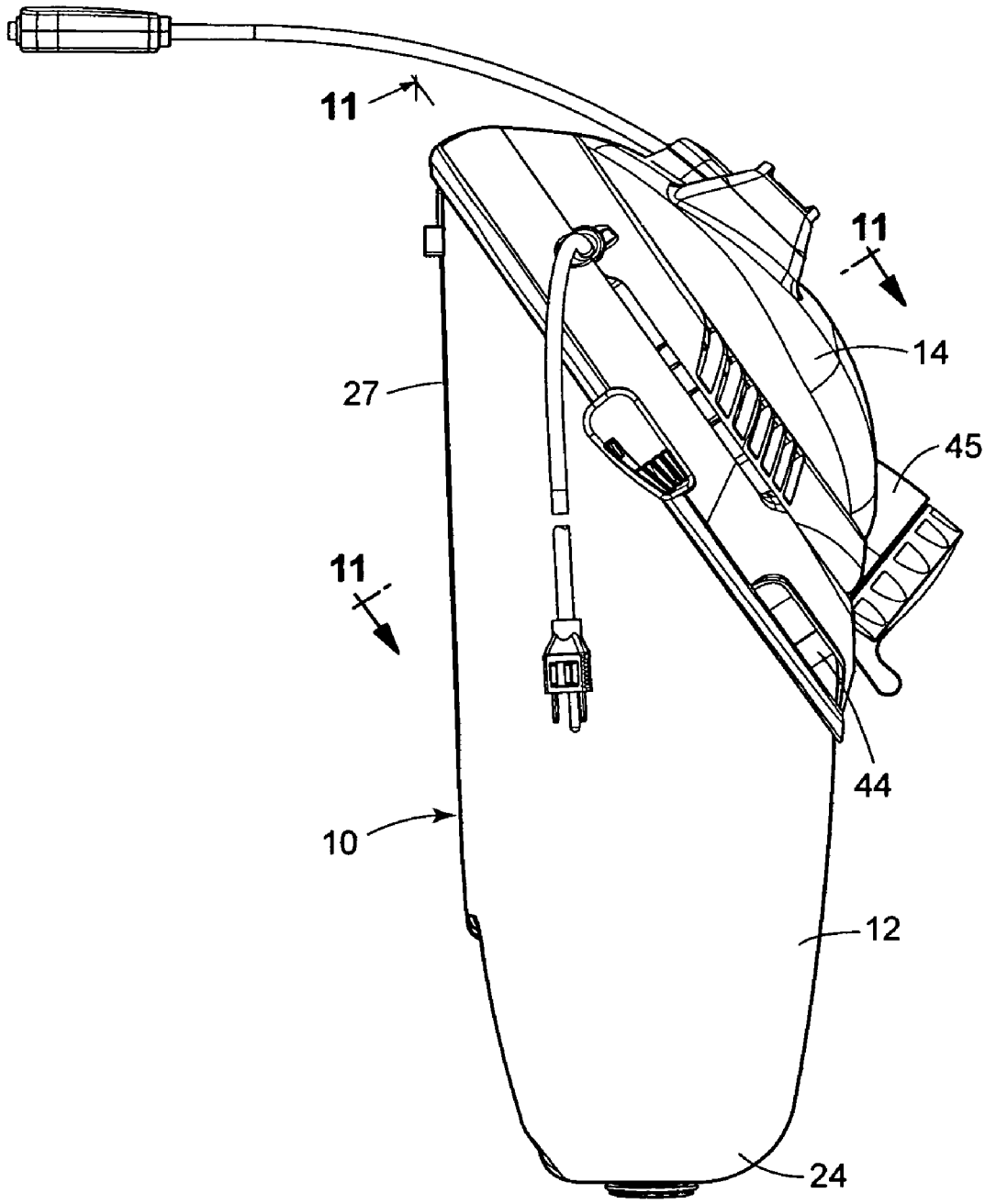
Figure 6:
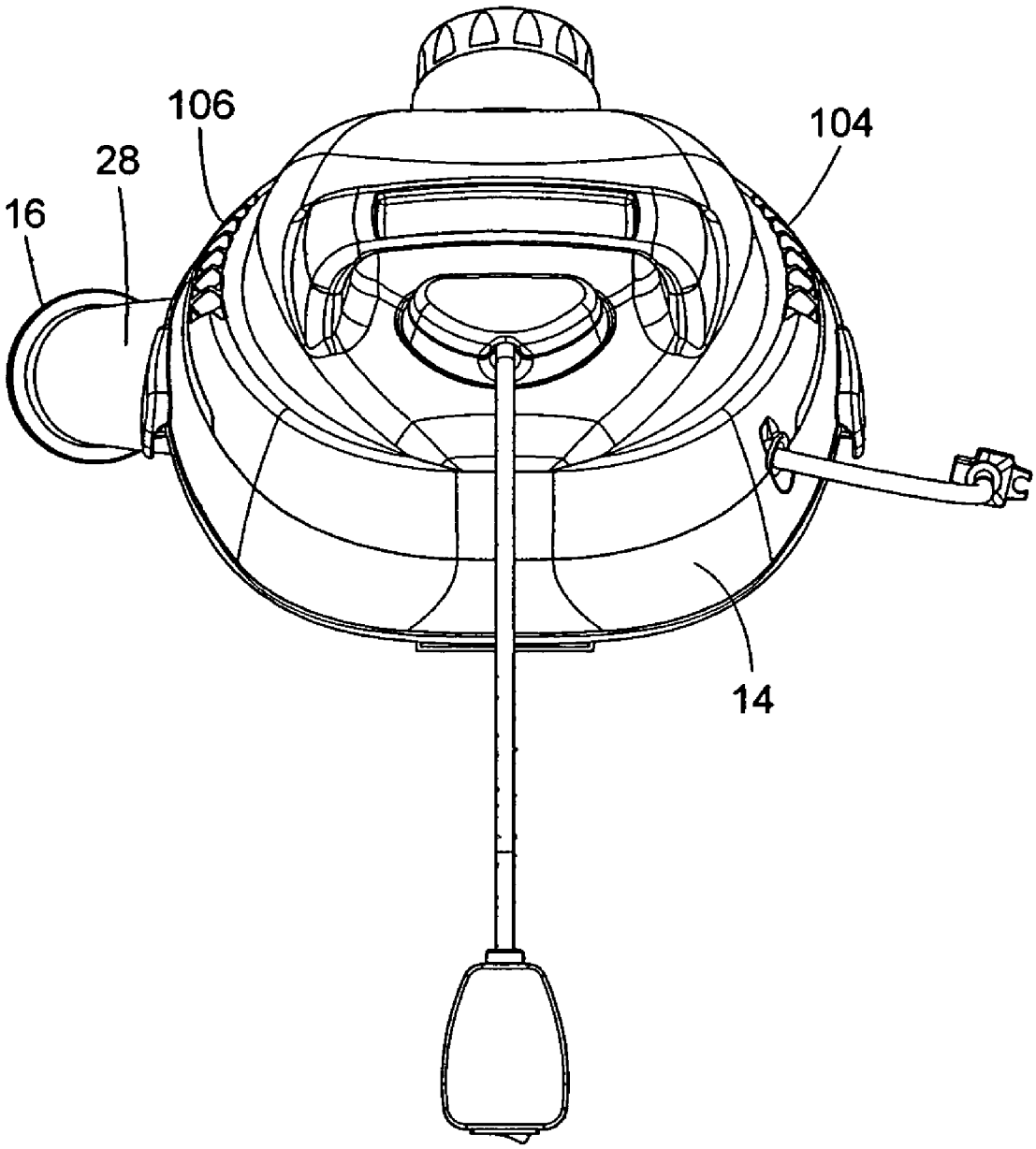
FIG. 6 is a top view of the vacuum, with the harness removed.
Figure 7:
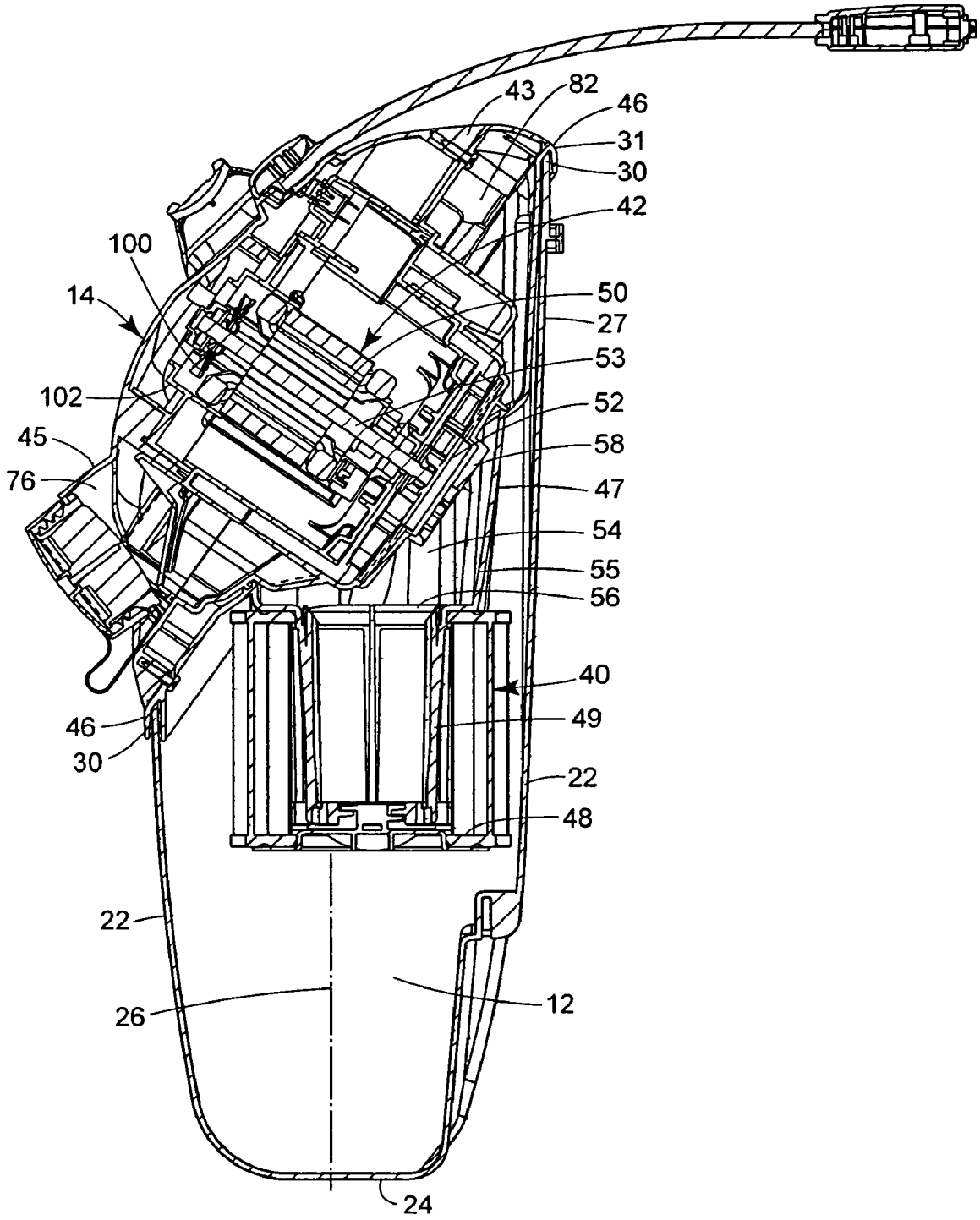
FIG. 7 is a sectional view through lines 7-7 in FIG. 3.

As seen in FIGS. 4 and 5, the lid assembly 14 covers the top of the tank 12. As seen in FIG. 7, the illustrated lid assembly 14 includes a filter assembly 40, a motor assembly 42, and a lid cover 43. The lid assembly also includes walls that form a pre-motor airflow path from the filter assembly 40 to the motor assembly 42, and a post-motor airflow path from the motor assembly to a pair of exhaust vents 44 (FIGS. 4 and 5). Air from the motor assembly can also be delivered through an optional blower duct 45 on the illustrated lid, as described below. The illustrated lid cover 43 is made of rigid plastic, and includes a rim 46 that is configured to mate with the upper edge 30 of the tank 12.

The dimensions of the tank 12 and the lid cover 43 can vary. Along the angled plane 31, the illustrated rim 46 measures approximately 15 inches wide from front to back; the illustrated lid cover 43 rises approximately 6 inches from the plane of the rim. With the lid assembly 14 attached, the overall unit depth D of the illustrated cleaner 10 (measured horizontally from the plane of the panel 27 near the user's back to the rearward-most point of the lid cover) is approximately 9 inches. The horizontal distance from the front of the tank to the center of gravity of the cleaner is approximately 4 inches. Other sizes and shapes could also be used. For ease of use, however, the overall unit depth is preferably no more than approximately 12 inches, and the distance from the front of the tank 12 to the center of gravity is no more than approximately 5 inches.

Figure 8:
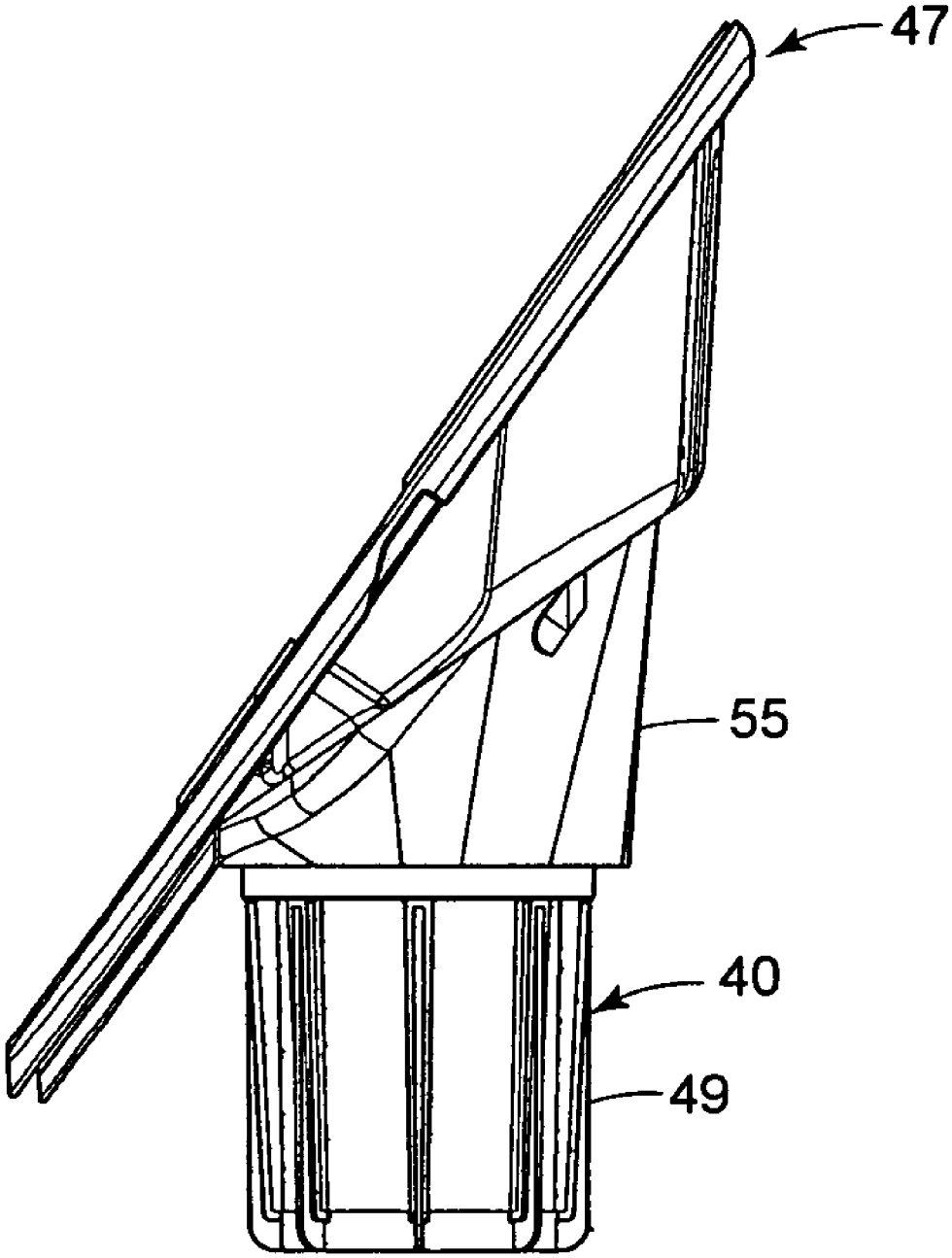
FIG. 8 is a side view of a filter cage used in the vacuum.

When the lid assembly 14 is attached to the tank 12, the filter assembly 40 is in fluid communication with the internal volume of the tank, and filters the air coming from the tank before the air reaches the motor assembly 42. Although other arrangements could be used, the illustrated filter assembly 40 includes a lid cage 47 (FIG. 8) on the bottom of the lid assembly 14. The illustrated lid cage includes a replaceable, cylindrical filter cartridge 48 that fits on a filter cage 49, but a wide variety of filter options can be used, including filters of other shapes and sizes, bags, cyclone chambers, etc.

The Motor Assembly

The motor assembly 42 powers the cleaner 10. The illustrated motor assembly (FIG. 7) is positioned centrally within the lid assembly 14, and includes a motor 50 and an impeller 52 that spins on a shaft 53. The illustrated motor is a 5½ horsepower electric motor, though other sizes and types of motors, including a switch reluctance motor, could also be used. Although other arrangements could be used, the illustrated impeller 52 is positioned axially beneath the motor 50, and is arranged for spinning air outwardly. The illustrated impeller 52 is approximately ⅜ inches high, with an external diameter of approximately 5 inches. The illustrated impeller shaft 53 is mounted at an acute angle with respect to the vertical, perpendicular to the angled plane 31 of the upper edge 30 of the tank 12.

Figure 9:
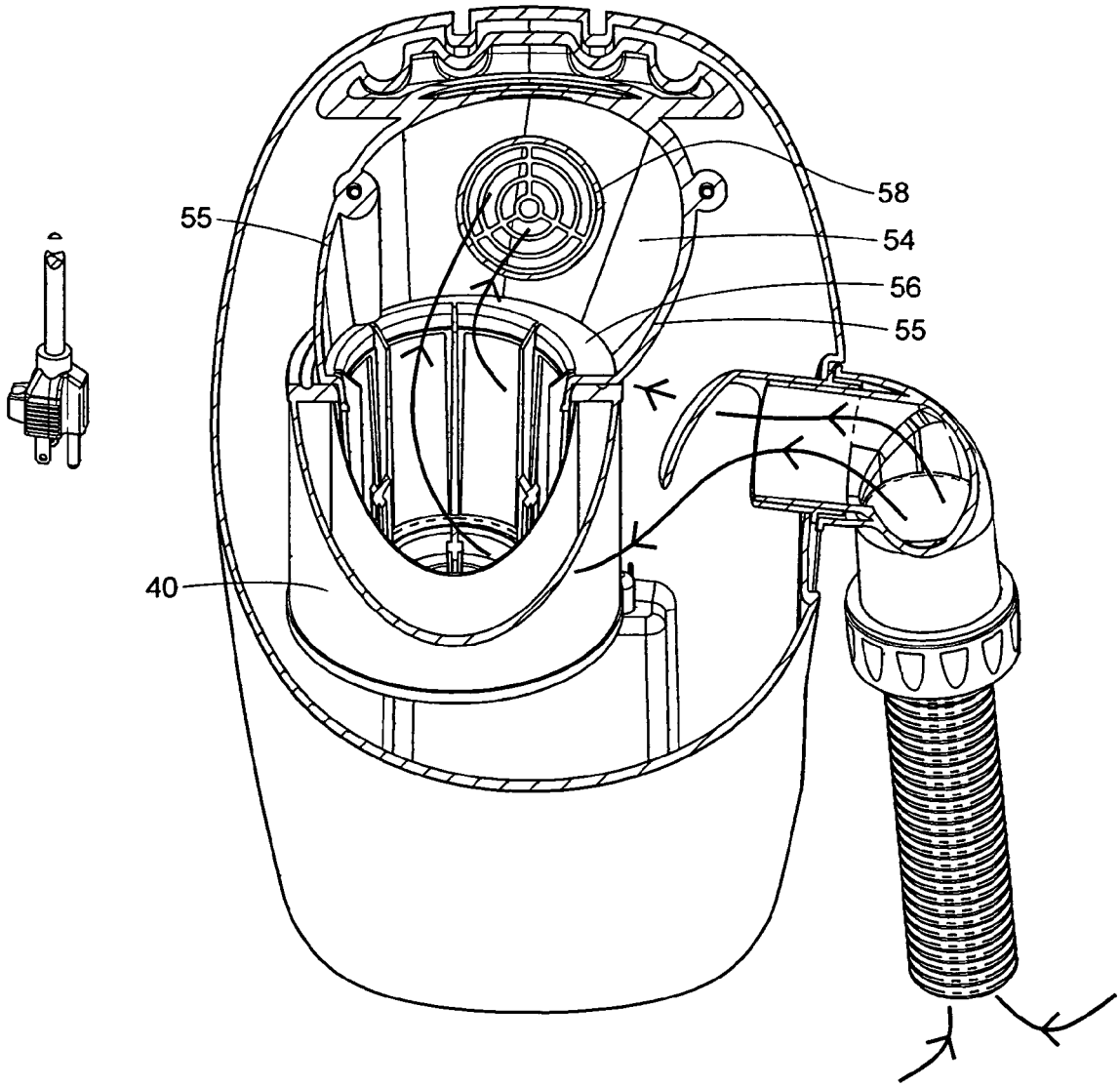
FIG. 9 is a sectional view through lines 9-9 in FIG. 4.

As best seen in FIGS. 7 and 9, the air path from the illustrated filter assembly 40 to the illustrated motor assembly 42 includes an inlet chamber 54 defined by walls 55 that extend from a mouth 56 of the filter assembly to an impeller inlet grill 58 on the motor assembly. Preferably, this air path is short and unrestricted. In the illustrated cleaner, the distance from the center of the mouth of the filter assembly 40 to the inlet grill 58 on the motor assembly 42 is approximately 2 inches, and the lateral walls 55 are widely spaced. Although other arrangements could be used, the short distance and wide spacing of the walls helps to keep the flow resistance through this air path relatively low.

The Post-Motor Airflow Chambers

The air path from the motor assembly 42 to the exhaust vents 44, on the other hand, is relatively long and tortuous. This arrangement helps to quiet the noise of the cleaner 10. In the illustrated cleaner, the air path from the motor assembly 42 to the exhaust vents 44 includes a variety of different chambers around the motor assembly. As discussed below, three tangential airflow chambers conduct the air in a tangential direction around the motor assembly. These chambers are divided by shared annular walls (walls that generally extend around the axis of the motor assembly, rather than toward it, and need not extend continuously all the way around the assembly, or be positioned at a constant radius). Collectively, the illustrated tangential chambers direct the air first to the back of the cleaner, then to the front of the cleaner, and then back again to the back of the cleaner, providing a relatively long, tortuous path.

Figure 10:
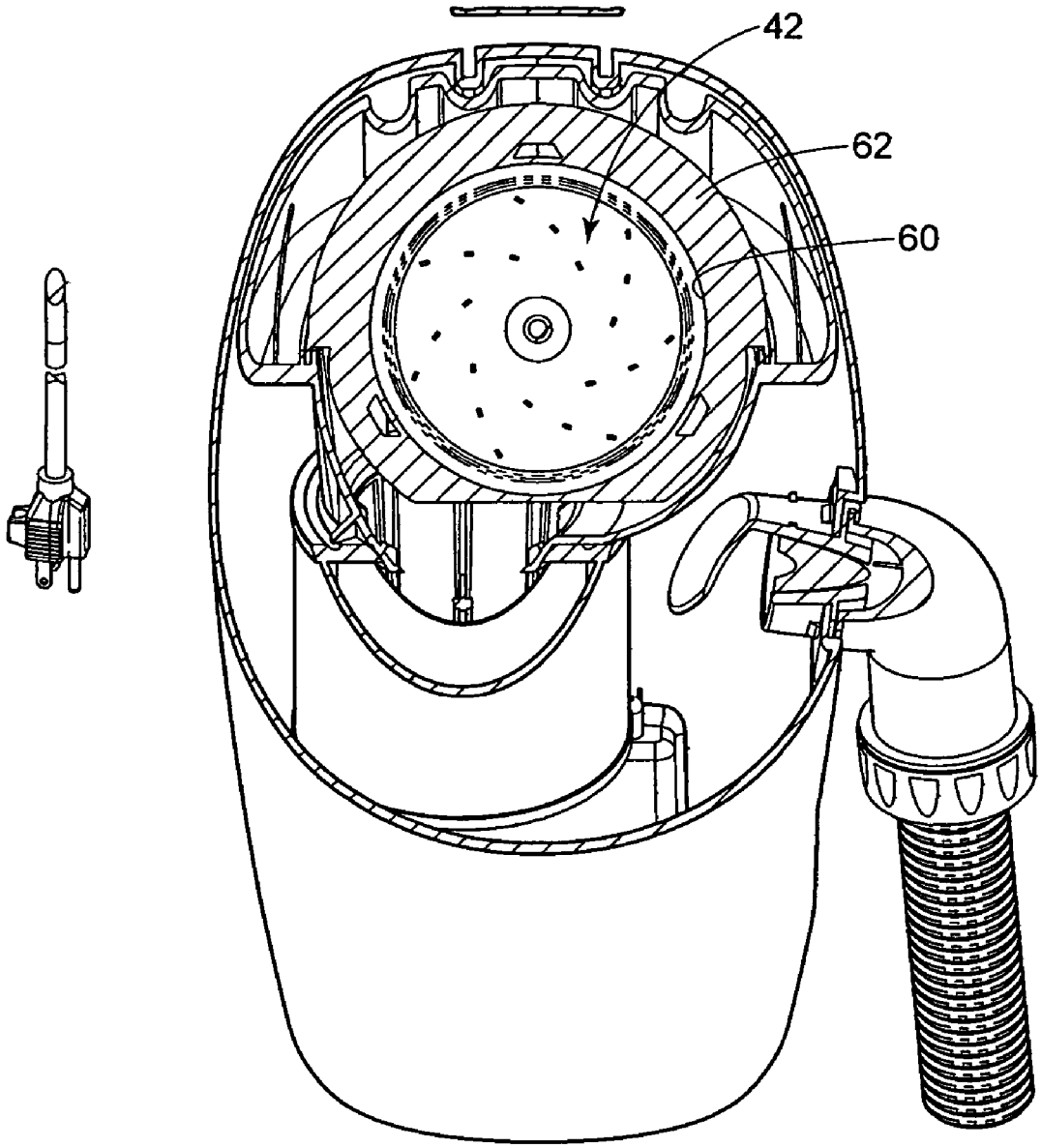
FIG. 10 is a sectional view through lines 10-10 in FIG. 4.
Figure 11:
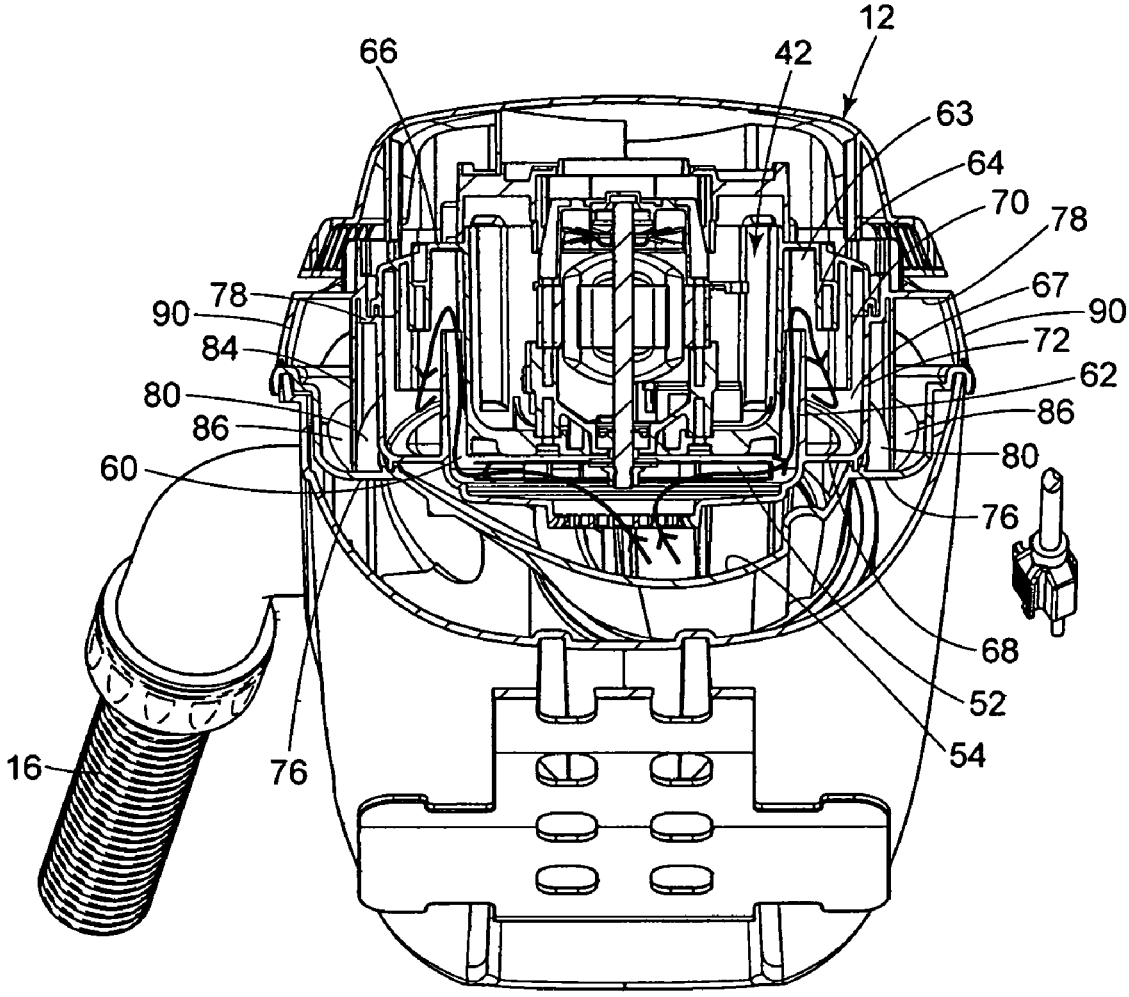
FIG. 11 is a sectional view through lines 11-11 in FIG. 5.

As best seen in FIGS. 10 and 11, air from the illustrated motor assembly 42 is blown into a first radial chamber 60 that is defined primarily by a first annular wall 62 that is approximately 3 inches high and is spaced approximately ½ inch radially away from the motor assembly. This chamber, which substantially surrounds the motor assembly, diverts the air from the impeller 52 and sends it upwardly.

The diverted air enters a second radial chamber 63 (FIG. 11) that is primarily defined by a second annular wall 70 that is approximately 1¼ inches high and is spaced even farther away from the motor assembly 42. The volume of the illustrated second radial chamber is approximately 12 cubic inches, but could vary in from 10 cubic inches to 14 cubic inches for similar units using other common motor assemblies. In this chamber, the air moves radially outwardly, causing its flow rate to decrease. An upper radial wall 66 requires the air to move downwardly.

Figure 12:
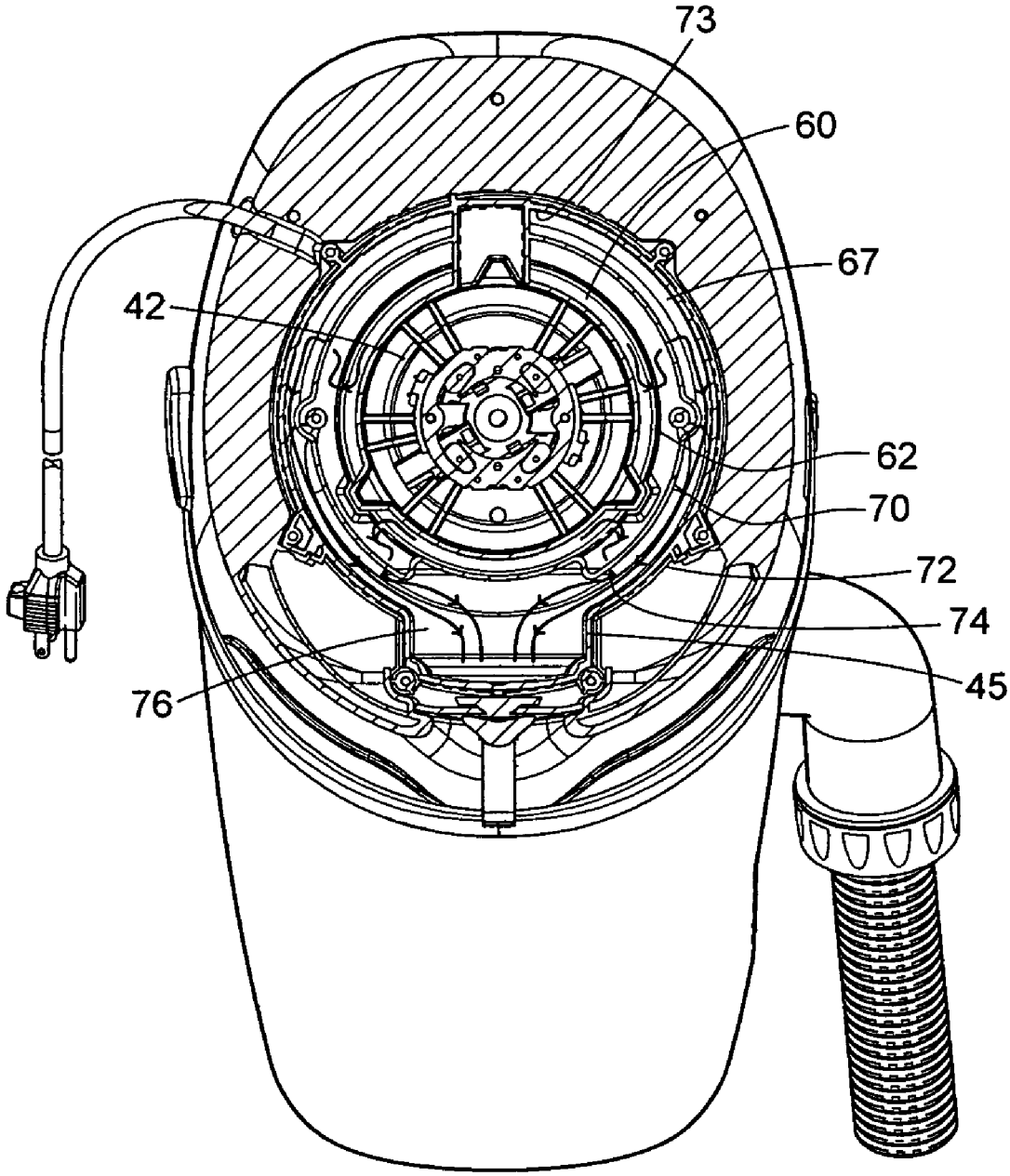
FIG. 12 is a sectional view through lines 12-12 in FIG. 4.

As seen in FIGS. 11 and 12, the downwardly-directed air then enters a first tangential airflow chamber 67 that—in the illustrated cleaner—is positioned radially outwardly from the first radial chamber 60 and substantially surrounds the impeller 52. This first tangential airflow chamber is defined by the first annular wall 62, a radial portion 68 of the wall 55 that defines the chamber between the filter assembly 40 and the motor assembly 42, and a third annular wall 72 that is positioned outwardly from the first annular wall 62. As seen in FIG. 12, this tangential airflow chamber 67 substantially surrounds the motor assembly 42. In this chamber, air is collected and directed rearwardly, in a tangential direction, to an outlet 74 located near the back of the cleaner.

The dimensions of this first tangential airflow chamber 67 can vary. The distances between the annular walls 62, 72 of this first tangential airflow chamber can vary from approximately ¾ inches to approximately 2 inches, and the height of those walls can vary from approximately ½ inches to approximately 2 inches. Preferably, the radial cross-sectional area of this chamber 67 will range from approximately 20 square inches to approximately 24 square inches when the illustrated cleaner is used with most conventional motor assemblies in use today. The lateral length of the illustrated chamber, from a forwardmost path position 73 toward the front of the cleaner to the outlet 74 near the back of the cleaner 10 is approximately 9 inches, but the distances between these path positions could vary from approximately 8 inches to approximately 10 inches in comparably-sized products arranged in a similar way with a similar motor assembly. The shortest flow path through this illustrated chamber 67 is approximately 5 inches. The size of the outlet 74 can also vary, from approximately 1 square inch to approximately 5 square inches for similarly-arranged products with a similar motor assembly.

Figure 13:
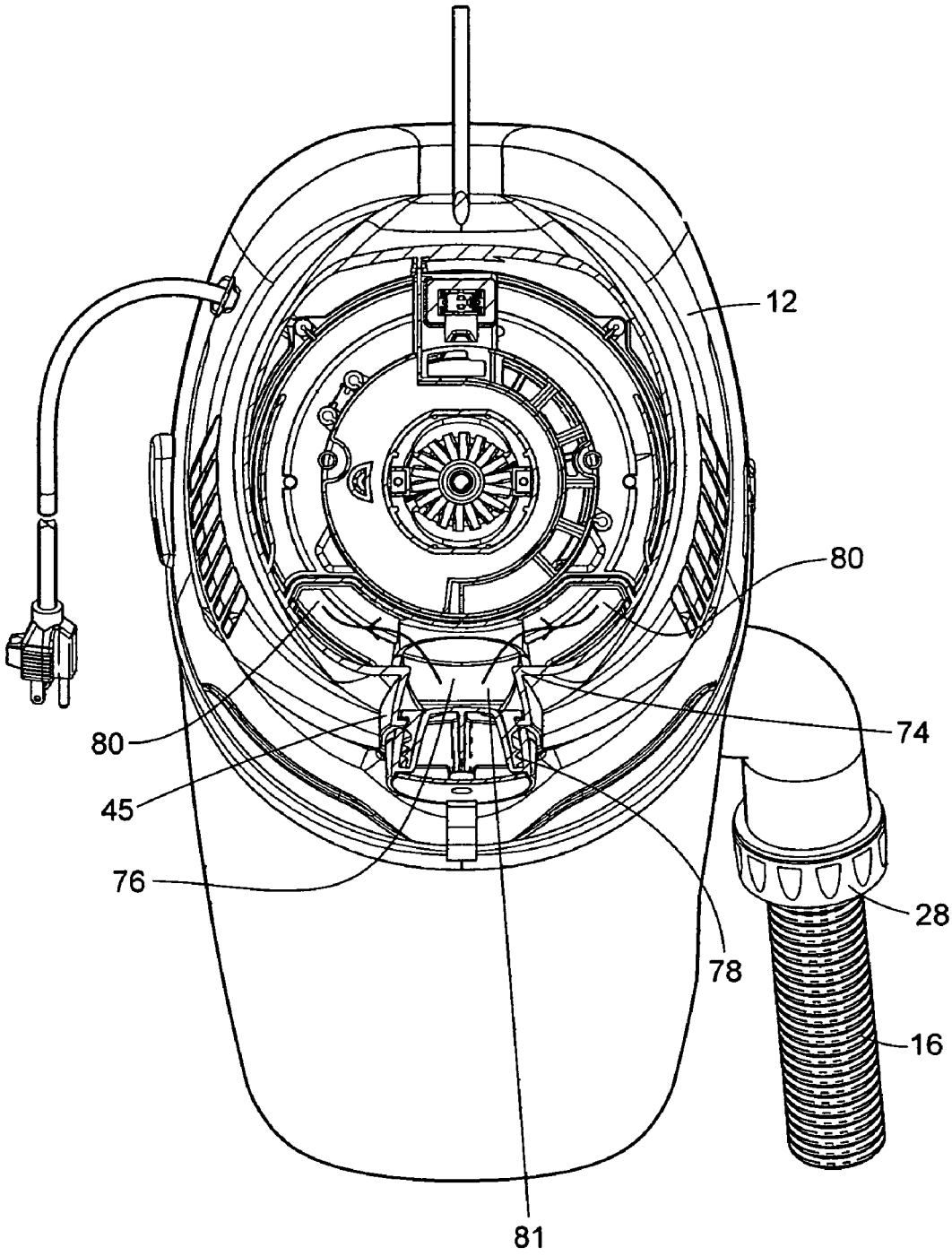
FIG. 13 is a sectional view through lines 13-13 in FIG. 4.

As seen in FIGS. 12 and 13, after passing through the outlet 74, air in the illustrated cleaner 10 moves upwardly into a conversion chamber 76. The path of the air after entering the conversion chamber depends upon whether the device is configured for vacuum use or for use as a blower.

For vacuum use, the 2½ inch diameter blower duct 45 on the illustrated lid assembly 12 is closed by a cap 78 (FIG. 13). The presence of the cap forces the air into a pair of lower tangential airflow chambers 80, where it ultimately proceeds to the exhaust vents 44, as discussed below.

Alternatively, the illustrated cleaner 10 can be configured for use as a blower by first removing the illustrated cap 78 from the blower duct 45. Then, a hose and fitting similar to the hose 16 and the fitting 28 that feed into the tank 12 can be inserted into the blower duct 45. The insertion of the fitting can seal off the path from the conversation chamber 76 to the tangential airflow chambers 80 and force the air into the hose.

Figure 14:
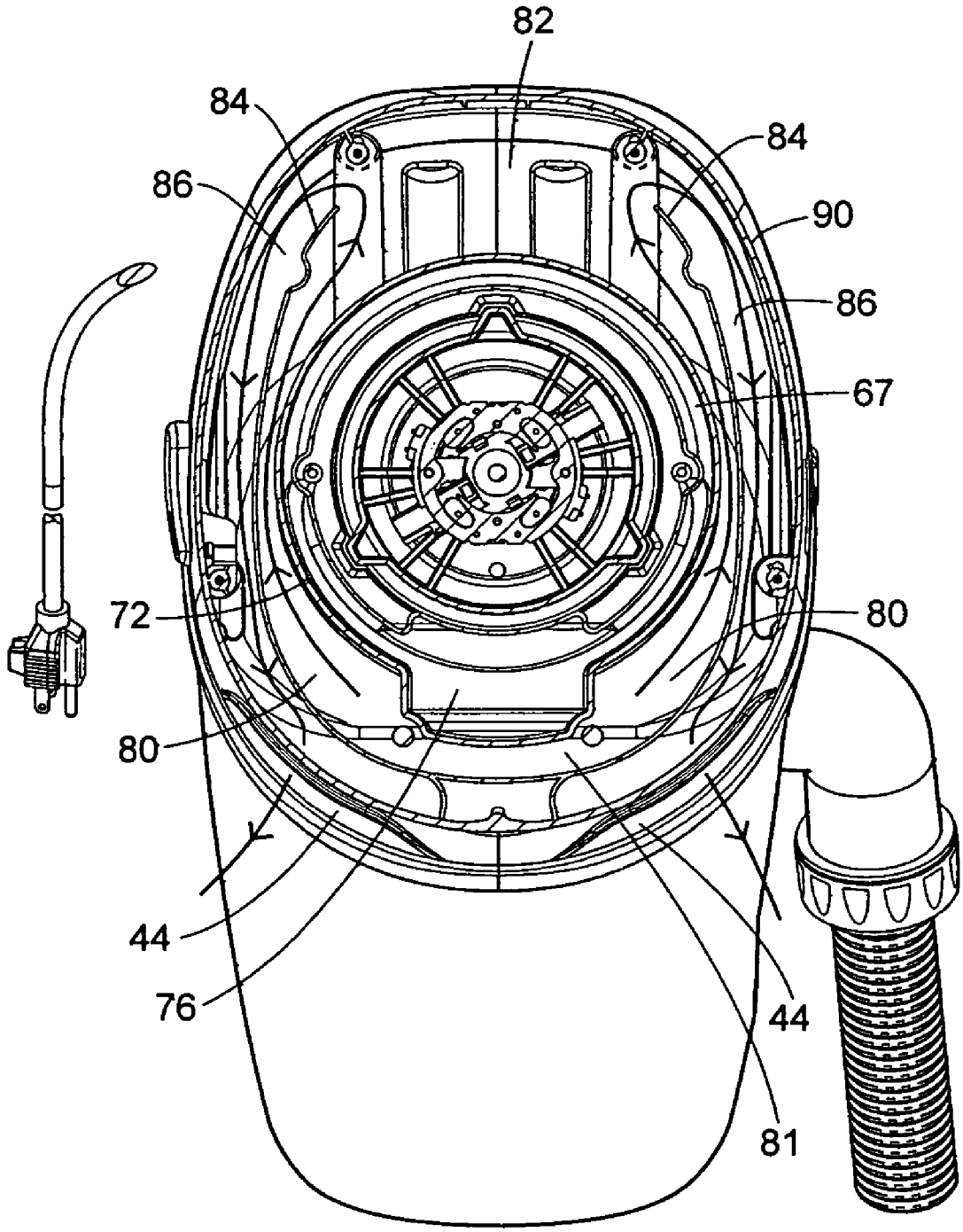
FIG. 14 is a sectional view through lines 14-14 in FIG. 4.

As seen in FIGS. 11 and 14, each of the illustrated lower tangential airflow chambers 80 is positioned radially outwardly from first tangential airflow chamber 67. These lower airflow chambers 80 extend substantially the entire overall unit depth of the cleaner 10. In these lower chambers, air is re-directed forwardly, again in a tangential direction, from a path position 81 near the conversion chamber 76 (FIG. 14) to a frontal chamber 82 near the front of the vacuum. The illustrated lower airflow chambers 80, which vary in height from approximately 1½ inches near the conversion chamber 76, to approximately 2½ inches at the mid-depth of the cleaner, to approximately 2 inches near the front of the cleaner 10, are defined by the third annular wall 72, upper and lower radial walls 76 and 78 (FIG. 11), and a fourth annular wall 84 that is spaced approximately ½ inches from the third annular wall. The lateral length of these tangential airflow chambers 80, from the conversion chamber 76 to the frontal chamber 82, is approximately 15 inches. This distance exceeds the overall unit depth, but could be varied.

As seen in FIG. 14, air can leave the frontal chamber 82 in the illustrated cleaner 10 through terminal tangential airflow chambers 86 that extend substantially the entire overall unit depth and lead to the exhaust vents 44 on the back of the cleaner 10. The terminal airflow chambers 86 are positioned radially outwardly from the lower air chambers 80. As seen in FIG. 11, the illustrated terminal airflow chambers 86 are defined by the fourth annular wall 84 of the lower air chambers 80, the upper and lower radial walls 76 and 78, and the outer shell 90 of the lid assembly 12, which is spaced approximately 1 inch from the fourth annular wall 84. The illustrated terminal air chambers 86 can vary in height from approximately 1½ inches to approximately 3 inches near the frontal chamber, to from approximately 2 inches to approximately 4 inches at the mid-depth of the cleaner, to from approximately ½ inches to approximately 2 inches near the exhaust vents 44. The lateral length of these terminal chambers 86, from the frontal chamber 82 to the exhaust vents, is approximately 14 inches.

In the illustrated cleaner 10, the overall air path from the impeller 52 in the motor assembly 42 to the exhaust vents 44 exceeds 40 inches. Preferably, the overall length of the airflow path from the motor assembly to the exhaust vents is at least 30 inches for cleaners using motor assemblies and arrangements comparable to the one illustrated.

Shaft Angle

As seen in FIG. 7, the impeller shaft 53 and the plane 31 of the lid cover 43 in the illustrated vacuum 10 are canted with respect to the axis 26 of the tank 12 and to the vertical. The various chambers in the lid assembly 12 are generally parallel to the plane 31 of the lid cover 43. Canting the angle of the impeller shaft 53 and the lid cover 43 reduces the rearward projection of the annular chambers and passages in the lid assembly 14. As noted above, the linear distance from the back of the frontal chamber 82 in the illustrated cleaner to the outlet 74 on the conversion chamber 76 (FIG. 14) is approximately 15 inches, and the linear distance from the front of the fourth annular wall 82 to the back of the exhaust vents 44 is approximately 11½ inches. However, because of the angle of the impeller shaft 53 and the lid cover 43, the overall depth of the vacuum 10 (including the blower port 45) is only approximately 11 inches, and the center of gravity of the unit is roughly ⅓ closer to the front of the unit (only approximately 4 inches in the illustrated embodiment) than it would have been if the same lid cover 43 and motor assembly 42 were arranged horizontally. Both the reduced overall depth of the unit and the reduced distance from the front of the tank to the center of gravity improve the ease of carrying and maneuvering the vacuum.

When the impeller shaft is angled, the overall depth of the unit can also be affected by the proposition of (a) the radial distance from the impeller to the farthest air chambers to (b) the axial height of those chambers. The lower this proportion, the more the impeller may need to be canted to reduce the overall depth of the unit. As can be seen in FIG. 7, the ratio of the (a) radial distance to the farthest points in the illustrated conversation chamber 76 and in the frontal chamber 82 to (b) the axial height of those chambers is roughly 2:1. With these proportions, a minimum cant of approximately 35° is required to reduce the overall depth of the unit. Units with distant chambers that are farther away for their height (i.e., that have a higher proportion of radial distance to axial height) may be able to obtain overall depth reductions with less tilt.

Arranging the impeller shaft 53 horizontally could minimize the rearward projection of the post-motor airflow chambers. However, pre-motor ducting generally includes an inlet chamber disposed axially below the impeller (like inlet chamber 54 in the illustrated cleaner 10), and a strictly horizontal arrangement of the impeller may result in the inlet chamber adding to the overall depth of the unit. Preferably, then, the impeller shaft is inclined sufficiently from the horizontal to prevent the required projection of the inlet chamber from adding to the overall unit depth. In the illustrated vacuum 10, the inlet chamber 54 will not add to the overall depth of the unit so long as the impeller shaft 53 is not angled more than approximately 70° with respect to the vertical. Steeper angles could be used, however, if the inlet chamber 54 were reconfigured.

Other Elements

The hose 16 allows the user to direct the suction of the unit to desired locations. Most conventional vacuum hoses can be adapted for use with the illustrated embodiment of the invention.

The harness 18 (FIGS. 1 and 2) allows the user to wear the cleaner 10 on his or her back. The illustrated harness 18 includes conventional adjustable shoulder straps 92 and an adjustable waist belt 94. Many other arrangements could be used.

An optional control pad 96 is connected to the illustrated cleaner 10 by a cord 98. The illustrated control pad allows the user to remotely turn the cleaner on or off, for example, or to control the speed or pressure of the flow of air through the cleaner.

As seen in FIG. 7, the illustrated vacuum 10 also has an optional motor cooling fan 100 on the motor 50. Ducting 102 creates a path from cooling-inlets 104 on the lid assembly 14 (FIG. 6) to the cooling fan 100, and from the cooling fan to cooling outlets 106 on the lid assembly. In the illustrated cleaner, the flow through the cooling air path is completely separate from the working airflow from the tank 12. Alternatively, filtered air from the tank could be used to cool the motor, as known to those skilled in the art.

Figure 15:
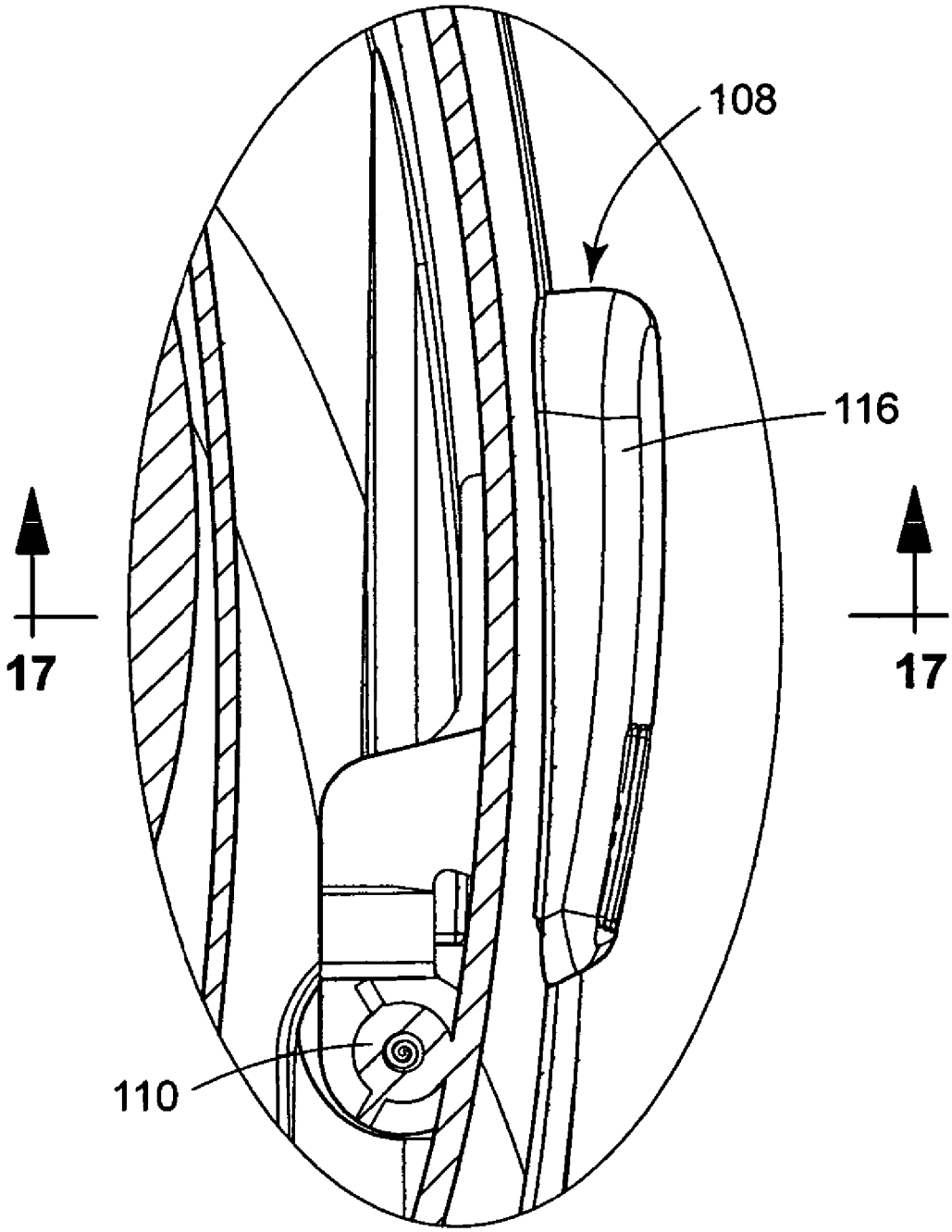
FIG. 15 is an enlarged fragmentary view of one of the latches, taken along the plane of FIG. 14.
Figure 16:
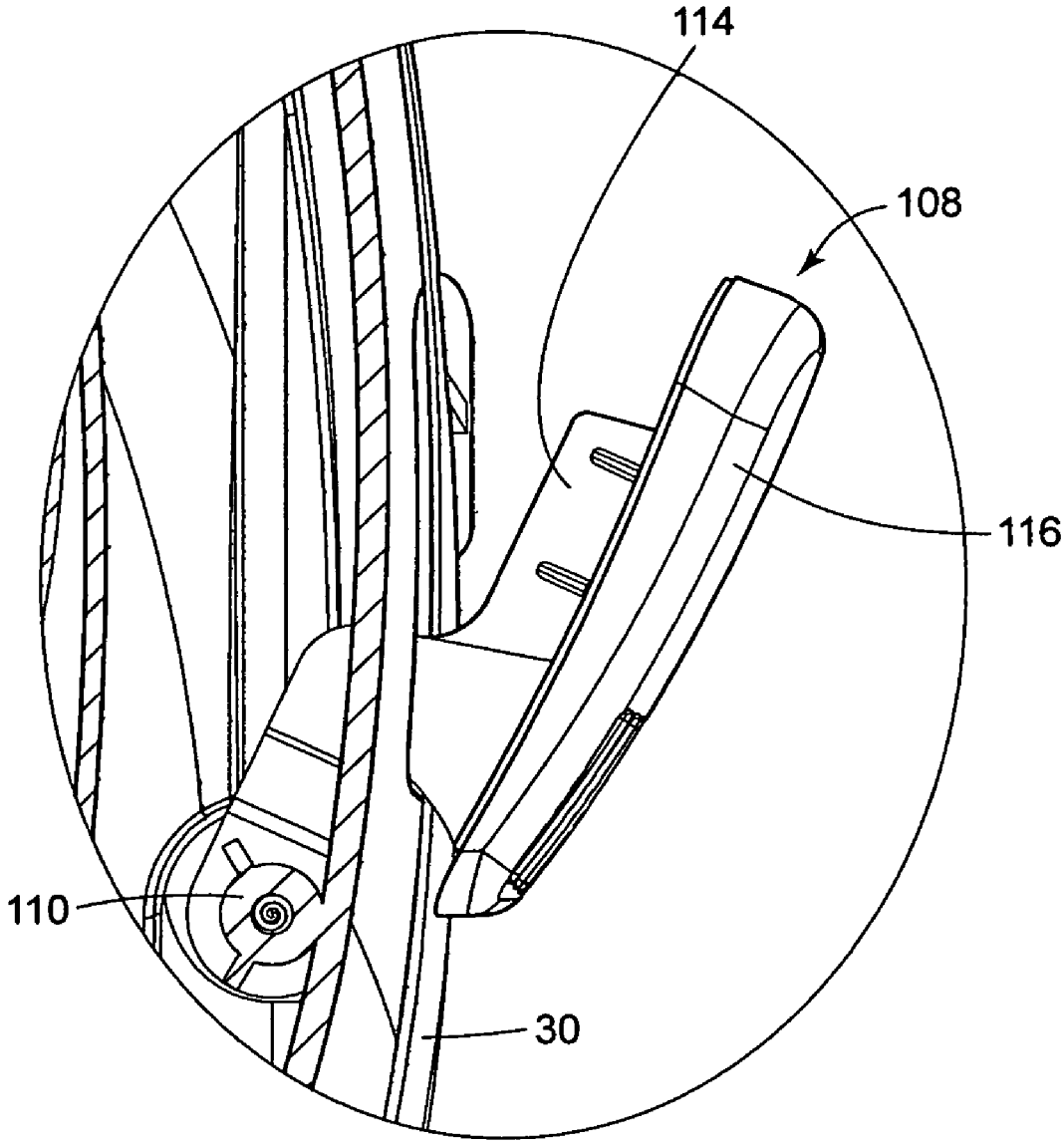
FIG. 16 is a fragmentary view corresponding with FIG. 15, but showing the latch in an open position.
Figure 17:
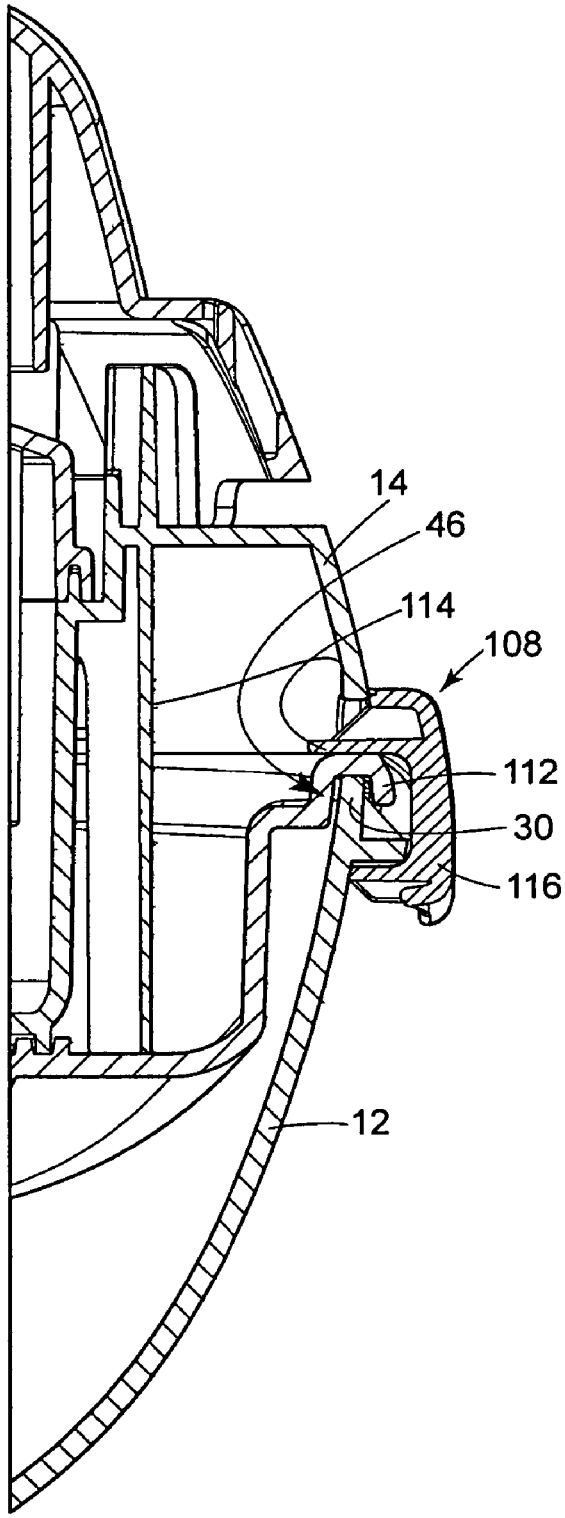
FIG. 17 is sectional view through lines 17-17 of FIG. 15.

As seen in FIGS. 15-17, latches 108 can be used to secure the lid assembly 14 to the tank 12. The illustrated latches are mounted on the tank with a pivot 110 (FIGS. 15 and 16) that enables the latch to open and close on the same plane 31 as the upper edge 30 of the tank. When the lid assembly 14 is in place, a lip 112 on the rim 46 (FIG. 17) projects over the side of the tank 12, preventing lateral movement. When the latch 108 is closed, an arm 114 inside the head 116 of the latch engages the top of the rim 46, holding the lid assembly 14 securely in place.

This description of various embodiments of the invention has been provided for illustrative purposes. Revisions or modifications may be apparent to those of ordinary skill in the art without departing from the invention. The full scope of the invention is set forth in the following claims.

The invention claimed is:

1. A pneumatic cleaner comprising:

a panel that is configured to fit against a user's back;

a motor assembly with an impeller on an impeller shaft that is mounted at an acute angle with respect to a vertical axis;

an overall unit depth that extends horizontally from the panel to a rearward-most point of the cleaner;

a first tangential airflow chamber that is disposed around the motor assembly and substantially surrounds the impeller; and a second tangential airflow chamber that is disposed around the motor assembly, radially outwardly from the first tangential airflow chamber, extends substantially the entire overall unit depth, and has a lateral length that exceeds the overall unit depth.

2. A pneumatic cleaner as recited in claim 1, and further comprising a harness that enables the cleaner to be carried on a user's back.

3. A pneumatic cleaner as recited in claim 1, and further comprising an annular wall that separates the tangential airflow chambers, extends substantially the entire overall unit depth, and has a lateral length the exceeds the overall unit depth.

4. A pneumatic cleaner as recited in claim 1, in which a front of the cleaner and the center of gravity of the cleaner are separated by a distance of no more than 5 inches, the cleaner has an air path from the motor assembly to an exhaust vent that exceeds 40 inches, and the overall unit depth is no more than 12 inches.

5. A pneumatic cleaner that has:

an overall unit depth;

an impeller with a shaft that is mounted at an acute angle with respect to a vertical axis;

a first tangential airflow chamber that substantially surrounds the impeller, extends substantially the entire overall unit depth, and has a lateral length that exceeds the overall unit depth; and a second tangential airflow chamber that is disposed radially outwardly from the first tangential airflow chamber, extends substantially the entire overall unit depth, and has a lateral length that exceeds the overall unit depth.

6. A pneumatic cleaner as recited in claim 5, in which the cleaner further comprises a third tangential airflow chamber that is disposed radially outwardly from one of the other tangential airflow chambers.

7. A pneumatic cleaner as recited in claim 5, in which the pneumatic cleaner is a vacuum cleaner.

8. A pneumatic cleaner as recited in claim 5, and further comprising a harness that enables the cleaner to be carried on a user's back.

9. A pneumatic cleaner as recited in claim 5, in which a front of the cleaner and the center of gravity of the cleaner are separated by a distance of no more than 5 inches and an air path from the impeller to an exhaust vent exceeds 30 inches.

10. A pneumatic cleaner as recited in claim 5, in which the cleaner has an overall depth that is no more than 12 inches and an air path from the impeller to an exhaust vent exceeds 30 inches.

11. A pneumatic cleaner as recited in claim 5, and further comprising first and second annular walls that separate the tangential airflow chambers.

12. A pneumatic cleaner as recited in claim 5, and further comprising an unhinged panel that is arranged to fits against a user's back.

13. A pneumatic cleaner as recited in claim 5, in which the impeller shaft is canted at between 25° and 75° with respect to the vertical.

14. A pneumatic cleaner as recited in claim 5, in which the cleaner has an axis and the impeller shaft is canted at between 25° and 75° with respect to the axis of the cleaner.

15. A pneumatic cleaner comprising:

a motor assembly;

a planar panel that is configured to fit against a user's back;

an overall unit depth that extends horizontally from the panel to a rearward-most point of the cleaner;

a first tangential airflow chamber that is disposed around the motor assembly; and a second tangential airflow chamber that is disposed around the motor assembly, extends substantially the entire overall unit depth, and has a lateral length that exceeds the overall unit depth.

16. A pneumatic cleaner as recited in claim 15, in which the cleaner has an impeller with a shaft that is canted at between 25° and 75° with respect to the vertical.

17. A pneumatic cleaner as recited in claim 15, in which the pneumatic cleaner is a vacuum cleaner.

18. A pneumatic cleaner as recited in claim 15, and further comprising a harness that enables the cleaner to be carried on a user's back.

19. A pneumatic cleaner as recited in claim 15, in which the a front of the cleaner and the center of gravity of the cleaner are separated by a distance of no more than 5 inches and an air path from the motor assembly to an exhaust vent exceeds 30 inches.

20. A pneumatic cleaner as recited in claim 15, in which the overall unit depth is no more than 12 inches and an air path from the motor assembly to an exhaust vent exceeds 30 inches.

21. A pneumatic cleaner as recited in claim 15, and further comprising a first annular wall that separates the tangential airflow chambers, and a second annular wall that separates one of the tangential airflow chambers from a third tangential airflow chamber.

22. A pneumatic cleaner as recited in claim 15, and further comprising a tank with an upper edge and a latch that opens on the same plane as the upper edge of the tank.

23. A pneumatic cleaner that has:

a motor assembly;

a panel that is configured to fit against a user's back;

an overall unit depth that extends horizontally from the panel to a rearward-most point of the cleaner;

a first tangential airflow chamber that is disposed around the motor assembly;

a second tangential airflow chamber that is disposed around the motor assembly, extends substantially the entire overall unit depth, and has a lateral length that exceeds the overall unit depth; and a third tangential airflow chamber that is disposed radially outwardly from the other two tangential airflow chambers.

* * * * *